United States Patent [19]

Uraneck

[11] 3,979,124

[45] Sept. 7, 1976

[54] PRACTICE GOLF CLUB

[76] Inventor: Carl A. Uraneck, Rte. 3, Box 148, Bartlesville, Okla. 74003

[22] Filed: Sept. 11, 1974

[21] Appl. No.: 505,072

Related U.S. Application Data

[63] Continuation-in-part of Ser. No. 378,682, July 12, 1973, abandoned.

[52] U.S. Cl. ..... 273/186 A; 273/186 C; 273/193 R; 277/77; 273/167 C; 273/167 E

[51] Int. Cl.[2] ..... A63B 69/36

[58] Field of Search ..... 273/80.1, 167 C, 167 E, 273/164, 194 A, 186 A, 186 C, 193 R, 77 A

[56] References Cited

UNITED STATES PATENTS

| | | | |
|---|---|---|---|
| 1,652,404 | 12/1927 | Graveure | 273/164 |
| 2,447,967 | 8/1948 | Stone | 273/164 |
| 3,310,309 | 3/1967 | Moss | 273/80.1 X |
| 3,384,376 | 5/1968 | Greenlee | 273/194 A |
| 3,437,341 | 4/1969 | Hasten et al. | 273/164 X |

*Primary Examiner*—George J. Marlo
*Attorney, Agent, or Firm*—Head, Johnson & Chafin

[57] ABSTRACT

A practice golf club having a shaft, grip and shank substantially identical to that of the golf club for which the practice golf club is made to represent. The practice golf club comprises a shaft with a handle grip on one end thereof and a club shank or hosel on the opposite end thereof which are substantially identical to the golf club for which the practice club is made to represent and a practice golf club head secured to the hosel, a striking face on one side of the practice golf club head, said striking face being disposed at the same angle and positioned as that of the representative golf club, the shape, area and size of the said practice club striking face being made to closely represent the sweet-spot area of the representative golf club. The weight of the practice club head is substantially equal to the weight of the golf club head. An embodiment of the practice club head wherein a wind resistance fin is secured to the club head body, said fin having an exposed front surface area and shape commensurate with that of the representative golf club head for duplication of wind resistance therewith and also wherein the combined weight of the practice club head and the wind resistance fin is equal to the weight of the representative golf club head.

6 Claims, 10 Drawing Figures

PRACTICE GOLF CLUB

CROSS REFERENCE

This is a continuation-in-part application of copending application Ser. No. 378,682, filed July 12, 1973 for PRACTICE GOLF CLUB, now abandoned.

BACKGROUND OF THE INVENTION

1. Field of the Invention

The present invention relates to practice golf clubs and more particularly, but not by way of limitation, to a practice club which is particularly designed and constructed to duplicate the swing characteristics of its representative golf club and which is provided with a striking face which is substantially identical in size, shape, and position to that of the sweet-spot area of the representative golf club for providing a golfer with a practice club to aid in developing a grooved accurate swing. The present invention is even more particularly, but not by way of limitation, designed for the use of light weight practice balls to enhance a golfer's swing while substantially reducing the possibility of the development of bad swing habits due to the light weight of the said practice balls.

2. Description of the Prior Art

It has long been recognized in the art that at a particular location of every golf club face there is a spot which is referred to in the art as "the club sweet-spot". The sweet-spot in the club is defined as the point on the club whereupon contact with the ball will not produce a twisting motion of the club and therefore will result in the maximum true flight of the golf ball with a minimum of vibration, jar, or twisting of the club itself. This sweet-spot would be more accurately defined as a spot on the club face coinciding with the center-of-percussion of the club when swung about an area coinciding with the handle grip of the club. It is therefore the desire of every golfer to develop a grooved swing so that the golf club head will strike the ball at a point on or very near the club sweet-spot.

This sweet-spot for a particular club may be found by any number of ways, the most common being that of suspending the club from the grip end and gently tapping the club face with a sharp object until a point is found thereon wherein the club will tend to rebound straight back without any twisting being detected at the club grip. However, since the sweet-spot or center of percussion on the face of the club will move slightly depending upon the radius of swing of the club, a more accurate method would be to utilize a mechanical golf club swing machine in determining the point of contact with the ball which results in maximum flight of said ball.

Since in practice it would be impossible to consistently strike the ball at the particular club sweet-spot it is important to determine a sweet-spot area which will be defined as that striking area which will produce a golf ball flight which is within ten percent of that flight produced by striking the ball at the sweet-spot.

This sweet-spot area for purposes of description herein may be closely represented by an elliptical shape having a horizontally disposed major axis length of approximately 1.84 inches and a vertically disposed minor axis length of approximately 1.275 inches. Naturally this area could be less accurately duplicated by a circular area having a diameter of approximately 1.275 inches. These figures are particularly suited for the MacGregor Tourney Driver, Lite 2. It is pointed out that the sweet-spot area shape and size will vary somewhat among commercially available golf clubs due to shaft stiffness, torsion characteristics, weight and club design but seldom is less than 15% nor more than 60% of the area of the club face.

One of the primary problems in the utilization of light weight practice balls is that after the golfer has spent much time utilizing the practice balls, he finds, upon using regulation or legal golf balls, that he has developed some other equally bad habits which did not show up by the use of the light practice balls. This is often due to the fact that the practice ball being so light may be struck at some point on the club face remote of the sweet-spot which will give the light practice ball a true flight whereas when a commercially available standard weight golf ball is struck at the same point a twisting motion is induced into the club thereby causing the ball to deviate from the optimum trajectory which decreases the accuracy of the ball and the range thereof.

One attempt to solve this problem was provided by the patent to Sabia, U.S. Pat. No. 3,126,206, issued in 1964, and entitled "PRACTICE GOLF CLUB AND TETHER BALL". The Sabia practice golf club utilized a standard golf club having an area about the sweet-spot of the club removed thereby forming a groove which is perpendicular to the striking face of the club whereby upon a perfect swing in relation to the tether ball, the club would simply pass the tether ball without touching it. This method has several disadvantages, one being that by removing a portion of the golf club the weight thereof is changed thereby changing the swing characteristics of the club for which the practice club is to represent. Naturally, extra weights could be added to bring the weight of the practice club equal to the weight of its representative club but this would not compensate for the second disadvantage, that being of failure to compensate for the wind resistance change caused by removing the afore described groove therefrom. Further, unless an exceptionally large groove is removed from the club it would be necessary for the golfer, in order to prevent the tether ball from swinging, to make an exact swing so that no part of the club would strike the ball. This is an unnecessary penalty on the golfer since often a good ball flight may be obtained by striking the ball near the sweet-spot or in the aforementioned sweet-spot area.

A second attempted solution was provided in the patent to Hasten, Jr., et al., U.S. Pat. No. 3,437,341, issued in 1969, and entitled "PRACTICE GOLF CLUB". The Hasten, Jr. device consists of the bolting onto the club face, a disc which extends outwardly from the club face and could be shaped to represent a club sweet-spot area. However, the addition of the disc and the attachment bolts would tend to change the club weight which would in turn change the swing characteristics of the practice club from that of the golf club for which it is to represent and further protrudes beyond the plane of the striking face of the said representative club. It is further noted that if the Hasten Club is utilized with the light weight plastic practice balls a practice ball might be struck at a point on the club face separate from the raised point and still obtain a true flight on the light weight plastic ball thereby giving the golfer a false indication of having obtained a swing grooved on the sweet-spot.

SUMMARY OF THE INVENTION

The present invention provides a practice golf club which is particularly designed and constructed for overcoming the above disadvantages. The present practice golf club comprises a shaft, grip and hosel or shank which are substantially identical to those of the golf club, for which the practice club is constructed to represent.

The practice club also comprises a practice club head having a flat striking face on one side thereof, said striking face having shape, size, and position commensurate with the shape, size and position of the sweet-spot area of the golf club for which the practice club is constructed to represent.

The present invention may also be provided with a wind resistance fin secured to the practice club head, the said resistance fin having an exposed surface area and shape substantially identical to the cross-sectonal shape of the representative golf club to duplicate wind resistance encountered thereby. The said wind resistance fin is positioned in a plane behind the striking face of the practice club head and is positioned at an angle with respect to the striking face. When the fin is constructed as a part of the practice club head, the head weight including the fin should be the same as that of the representative golf club.

With the present invention the user can practice his swing by hitting plastic or light weight practice balls but is forced to improve and groove his swing because of the restricted area of the striking face of the practice club. Since the said striking face of the practice club is restricted in area and shape to the sweet-spot area of his representative golf club, unless the practice ball is contacted within the sweet-spot area, it will either be missed completely or will be greatly deflected to one side or the other which will exaggerate error caused by missing the sweet-spot area or hitting balls adjacant to the sweet-spot area.

Also, since the striking face of the practice club head is disposed at an angle and within a plane which is substantially identical to the face angle and plane of the representative club, the present invention may not only be used as a practice club with light weight plastic practice balls but may be used as a practice club for the driving range when it is desired to strike the ball and feel the associated impact therewith. Further, it is noted that since the wind resistance fin is positioned at an angle with respect to the striking face of the practice club head, any light weight practice ball hit by the fin as opposed to the striking face will also be deflected.

Typical commercially available golf clubs come in various configurations to suit the needs of the individual user. The primary variables readily available relate to weight, shaft length and shaft stiffness which also relates directly to the swing characteristics of the club. The user of the practice club described herein could purchase a practice club having weight, shaft length and shaft stiffness corresponding to one of his standard clubs. For instance, he may desire to purchase a practice club representative of his driver and a second practice club representative of a mid range iron such as a 5-iron. With the weight, shaft length and stiffness, and wind resistance being the same as his representative standard club, his practice club should display the same "swing characteristics" or "swing feel" as that of its representative standard club.

Practice with the present invention will greatly improve the user's game because he will tend to hit more standard weight golf balls with his standard golf club in the sweet-spot area. The frequency of hitting the sweet-spot area is one of the distinguishing differences between a low and a high handicap player.

One of the primary objectives of the present invention is to provide a practice golf club having substantially identical swing characteristics, weight, balance, shaft length and grip characteristics of the representative golf club while providing a club face that forces the golfer to develop a grooved swing for contacting the ball with the club face at or near the club sweet-spot.

DESCRIPTION OF THE DRAWINGS

Other further advantageous features of the present invention will more fully appear in connection with a detailed description of the drawings, in which.

DESCRIPTION OF THE PREFERRED EMBODIMENT

Figure 1:
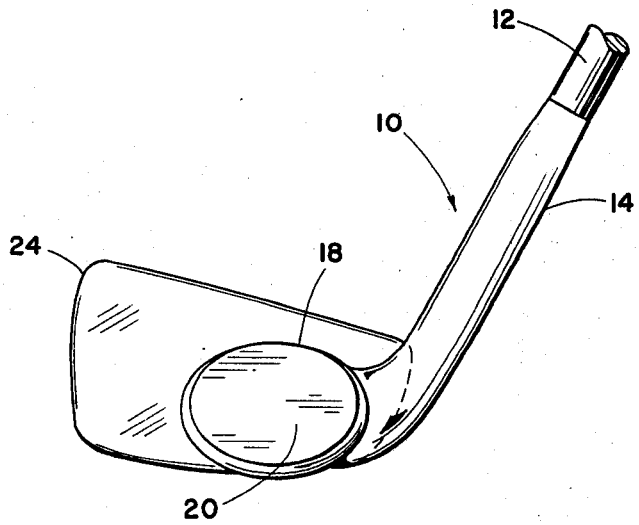
FIG. 1 is an elevational front view of a practice golf club embodying the present invention.
Figure 2:
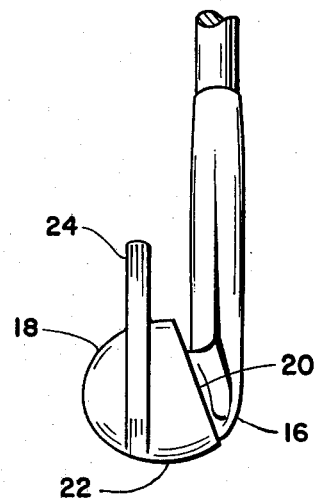
FIG. 2 is a side elevational view of the golf club of FIG. 1.
Figure 3:
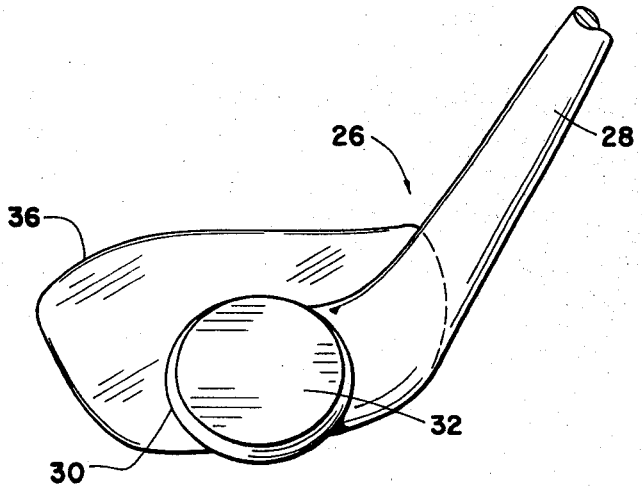
FIG. 3 is a front elevational view of golf club wood embodying the present invention.
Figure 4:
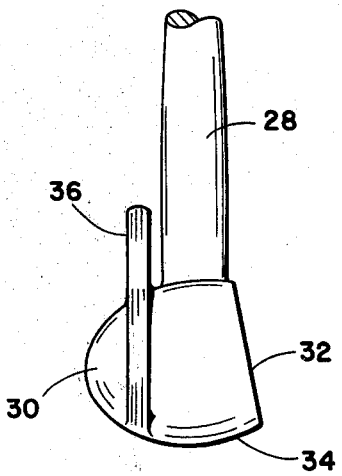
FIG. 4 is a side elevational view of the golf club wood of FIG. 3.
Figure 9:
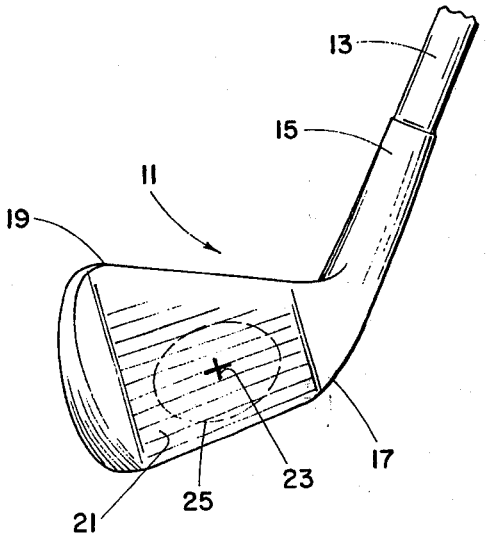
FIG. 9 is a perspective view of a typical golf club iron depicting the sweet-spot and surrounding sweet-spot area.
Figure 10:
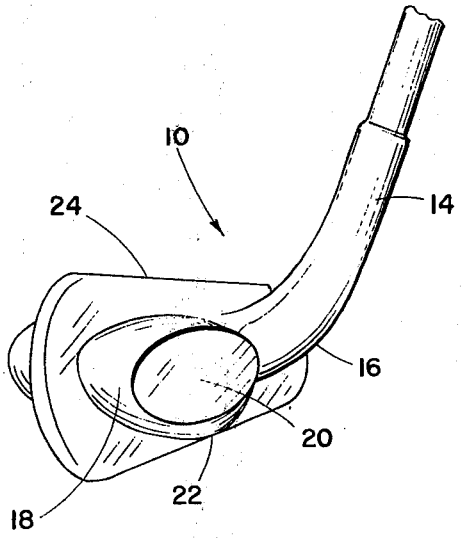
FIG. 10 is a perspective view of a practice club made to represent the club iron 11 FIG. 9 and embodying the present invention.

Referring to FIGS. 1, 2 and 10 of the drawings, reference character 10 generally indicates a practice golf club representative of a typical golf club iron 11 shown in FIG. 9. The golf club iron generally comprises an elongated shaft 13 having a grip member (not shown) at one end thereof, a hosel 15 being attached at the opposite end thereof. The lower portion of the hosel is provided with a curved portion 17. Attached to the curved portion 17 is a blade member 19 having a flat base portion and having a striking face 21 which is inclined at an angle with respect to the base portion in order to empart loft to a ball (not shown) when struck by the face portion 21 of the blade 19.

There is a point on the face portion 21 of the blade 19 which represents the center of percussion of the club called the sweet-spot and designated by reference character 23. The sweet-spot area as hereinbefore described is depicted by the oval shaped broken line 25.

The practice club iron 10 comprises a shaft 12 which is of weight, length and material substantially identical to the shaft 13 of the iron 11 and having a handle grip (not shown) which is also substantially identical to that of the club iron 11. A sleeve member or hosel 14 is secured to the lower end of the shaft 12 in a manner substantially identical to the hosel 15 of the club iron 11. The lower end of the hosel 14 is provided with a rearwardly extending curve at the point 16. A practice club head 18 is secured to the lower end of the hosel 14 adjacent to the curved portion 16.

The connection between the practice club 18 and the end of the hosel 14 may be by welding, braising or other well known methods. The practice club head 18 is provided with a single striking face 20 which is set or disposed at an angle from the base which is substantially equal to the angle face 21 of the club iron 11 which is representative of the practice club 10. For example, in the case of lower numbered irons, the angle of the face 20 from the vertical would be less than that angle when the practice club 10 is representative of the higher numbered irons or the pitching wedge. The striking face 20 of the practice golf club 10 is constructed having a size and shape which is substantially identical to the size and shape of the sweet-spot area 25 of the representative of the club 11. It is also necessary that the striking face 20 be disposed with respect to the end of the shaft at a position corresponding to the position of the sweet-spot area 25 of the club iron 11.

Again, for purposes of definition the sweet-spot area 25 is defined as a striking area which will produce a ball flight within ten percent of that flight produced by striking the ball exactly on the sweet-spot 23. For ease of description the sweet-spot area 25 may be less accurately defined as an elliptical shape having a horizontally disposed major axis length of approximately two inches and a vertically disposed minor axis of 1.37 inches. These figures are particularly suited for an Acushnet Co., Titleist 5-iron, D3 weight club and will vary somewhat among commercially available clubs. The body of the club head 18 extends rearwardly from the striking face 20 by an amount sufficient to substantially duplicate the actual weight of the representative club iron 11. The bottom surface 22 of the club head 18 may be curved downwardly and rearwardly to duplicate the lower edge or base portion of the representative club iron 11.

A flat plate wind resistance fin 24 may be secured to the practice club head in any well known manner, such as by braising or welding. The said wind resistance fin 24 should be disposed on the club head 18 in a position to prevent its interfering with the striking face 20 thereof. The shape of the resistance fin 24 is substantially identical to the shape of the blade 19 of the representative club iron 11 so that the front face of the practice fin 24 substantially duplicates the area and shape of the blade 19 of the representative golf club 11 in order to insure that the wind resistance of the practice club 10 is substantially identical to that of the representative club iron 11.

Further, the wind resistance fin 24 should be disposed at an angle with respect to the striking face 20 as shown in FIG. 2 so that when using light weight practice balls, a ball struck by the fin will be deflected indicating to the user that ball has been improperly hit. The fin 24 would optimumly be disposed in a vertical plane when the club is in the address position as shown in FIG. 2.

It is noted at this point that in calculating the weight of the practice club head there are certain controlling dimensions which must be kept fixed. For example, the striking face 20 must present a particular shape consistent with the sweet-spot area 25 for the representative club iron 11 and whereas the wind resistance fin should maintain the particular size and shape of the face 21 of the blade 19 of the representative club iron 11. Therefore, the rearward extension of the body 18 may be varied and the thickness of the wind resistance plate 24 may be varied to obtain a total design weight which is substantially equal to the weight of the representative golf club iron 11.

Referring now to FIGS. 3, 4, 7 and 8, reference character 26 generally indicates a practice club wood constructed to represent a typical golf club wood shown at 27. The club wood 27 generally comprises an elongated shaft 29 having a grip member (not shown) secured to one end thereof and a hosel portion or shank 31 secured to the opposite end. A club head body 33 having a flat portion is secured to the shank 31 or can be constructed as an integral part thereof. One side of the body 33 is provided with a flat striking face 35 which is disposed at an incline with respect to said base portion in much the same manner at that of the iron 11 in order to impart loft to the ball (not shown) which is struck thereby.

Like that of the club iron 11, the face 35 of the wood 27 has a sweet-spot thereof represented by reference character 37 and which is surrounded by a sweet-spot area depicted by the oval shaped broken line 39.

The practice club 26 comprises a shank member 28 which is substantially identical to the representative wood shank 31 having a club head 30 secured to the lower end of said shank. Again the practice club wood 26 comprises a shaft and grip (not shown) attached to the upper end of the shank 28 which are substantially identical with those of the representative club wood 27 in every way.

The club head 30 is provided with a single striking face 32 which has a shape and size corresponding to that of the sweet-spot area 39 for the representative club wood 27. The striking face 32 is disposed at an angle or pitch from the vertical which is equal to the angle of the face 35 the representative club wood 27. For instance, the angle from the vertical on the lower numbered woods would be much smaller than the angle from the vertical with the higher numbered woods. The base of the practice club head 30 extends downwardly and rearwardly at 34 in order to duplicate the lower base portion of the body 33 of the representative club wood 27.

A wind resistance fin 36 is secured to the club head 30 and disposed rearwardly from the striking face 32 to prevent interference therewith. The wind resistance fin 36, like that of the practice club iron 10, is shaped to essentially duplicate the front face section of the representative club wood 27 so that the striking face 32 together with the wind resistance fin 36 will essentially duplicate the wind resistance encountered by the representative club wood 27.

It is also noted that the fin 36 should be disposed at an angle with respect to the striking face 32 in order to produce a deflection of a light weight practice ball if struck by the fin 36 as opposed to the face 32.

In calculating the weight of the practice club head, certain dimensions must be held constant. The shape and area of the striking face 32 must essentially duplicate sweet-spot area 39 for the representative club head and the shape and area of the wind resistance fin 36 must substantially duplicate the cross-sectional shape and area of the representative club head 33.

Therefore, the weight of the practice club head may be varied by either varying the thickness of wind resistance fin 36 or the rearward extension of the club head 30 or both in order to duplicate the weight of the representative club head 33.

From the foregoing it will be apparent that the present invention provides a practice club which may be designed to substantially duplicate the weight and swing characteristics of a representative golf club whether it be a wood or an iron. The striking face provided on the practice club head is particularly designed and constructed to duplicate the sweet-spot area of the representative club heat both in size, shape and angle of inclination. The practice club head may also be provided with wind resistance fins so that the entire swing characteristics of the representative club head is duplicated in the practice club. It is also readily found that the wind resistance fins being disposed substantially rearward of the striking face will serve to duplicate the wind resistance encountered by the representative club head while still not interfering with the striking face of the said practice club head. Whereas the club may be freely used on a driving range or the like with regular legal golf balls, it is particularly adaptable to use with the light weight plastic balls for developing a groove swing which is particularly grooved on a golf club sweet-spot area.

Figure 5:
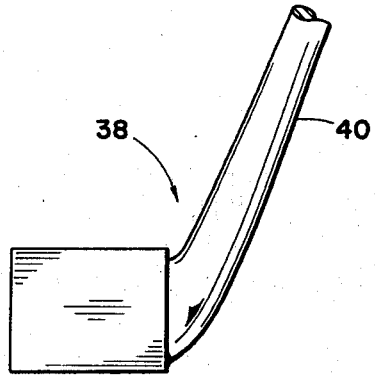
FIG. 5 is a front elevational view of a practice golf club representing a second embodiment of the present invention.
Figure 6:
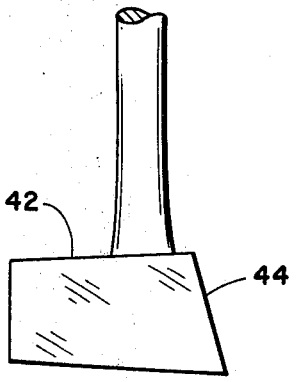
FIG. 6 is a side elevational view of the practice golf club of FIG. 5.
Figure 7:
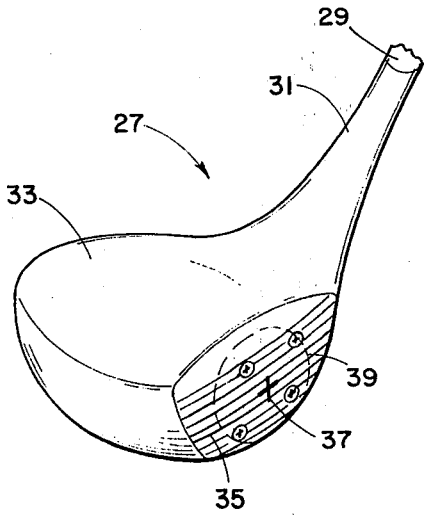
FIG. 7 is a perspective view of a typical golf club wood depicting the sweet-spot and surrounding sweet-spot area.
Figure 8:
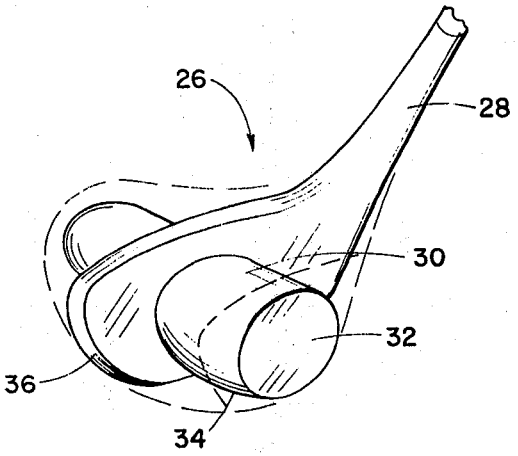
FIG. 8 is a perspective view of a practice club made to represent the club wood of FIG. 7 and embodying the present invention.

Referring now to FIGS. 5 and 6, reference character 38 generally indicates a practice club which represents a simplified version of the practice club wood 26 heretofore described. The practice club 38 is provided with a shank member 40 which is substantially identical to that of the representative club shank and is provided with a shaft and grip (not shown) which is representative of the club shaft and grip in weight, length and material used.

A practice club head 42 is secured to the lower end of the shank 40 in a well known manner such as by welding, braising or the like, the said club head 42 being of substantially rectangular shape for ease of manufacture thereof. The practice club head 42 is provided with a striking face 44 which has an area and general shape corresponding with the area and shape of the sweet-spot area of the representative legal club head. It is noted that by maintaining a rectangular cross-sectional shape that the shape of the sweet-spot area will not be duplicated but will be sufficiently represented for most practice purposes. The striking face 44 is disposed at an angle from the vertical which is representative of the pitch angle of the representative golf club and the body of the club head 42 extends rearwardly from the striking face 44 thereof by an mount sufficient to duplicate the weight of the representative golf club head. It is noted that a wind resistance plate similar to the wind resistance fins 24 and 36 of the embodiments hereinbefore described could be added to the practice club head 42 but in the interest of simplicity has been omitted. It is noted, however, that some compensation for the wind resistance may be made by slightly increasing the weight of the club head 42 beyond that of the representative legal club head whereby during the acceleration phase of the swing added resistance will be felt due to this increased weight. Also due to the rectangular cross-sectional shape of the club head 42 calculation of the proper weight thereof will be greatly simplified.

It is noted in all three embodiments hereinbefore described that the material for the club head is not critical so long as the area at the striking face is of sufficient hardness to maintain its shape upon encounter with standard golf balls. Also metals of various densities may be used depending upon the compactness desired by the manufacture thereof.

Whereas, the present invention has been described in particular relation to the drawings attached hereto, other modifications apart from those shown or suggested herein may be made within the spirit and scope of this invention.

What is claimed:

1. A practice golf club for use as a substitute for a golf club, said golf club having a shaft, a grip at one end of said shaft, a shank at the opposite end thereof, a club head secured to the shank and having a flat base portion thereon, a front striking face provided on one side of the club head and disposed at an incline extending upwardly and rearwadly from the front edge of the base portion, a sweet-spot on said club face representing the center of percussion of the golf club when swung about an axis at the grip and having a sweet-spot area smaller than the club face and lying on said face surrounding the sweet-spot; said practice club comprising:

1. a shaft substantially identical to the shaft of the golf club,
2. a grip at one end of the shaft substantially identical to the grip of the golf club,
3. a shank at the opposite end of the shaft of the type on the golf club,
4. a practice club head having the same weight as that of the golf club head secured to the shank and having a base portion and a front striking face on one side thereof, said practice club striking face extending upwardly and rearwardly from the front edge of the base portion and being disposed at an incline and position with respect to the base portion of the practice club head substantially identical to the corresponding incline and position of the striking face of the golf club, the practice club striking face having a sweet-spot at the same position of the sweet-spot of the golf club, said practice club striking face being of a size smaller than the golf club striking face and surrounding the sweet-spot.

2. A practice golf club as set forth in claim 1 wherein the size of the striking face area of the practice club head represents not more than 60% of the total area of the striking face of the golf club.

3. A practice golf club as set forth in claim 2 wherein the size of the striking face area of the practice club head represents not less than 15% of the total area of the striking face of the golf club.

4. A practice golf club as set forth in claim 1 wherein the shape of the sweet-spot area of the golf club is oval having the major axis thereof parallel to the base portion of the club head, the minor axis being perpendicular to the major axis, the shape of the striking face of the practice club head being substantially identical to that of the sweet-spot area of the golf club.

5. A practice golf club as set forth in claim 1 wherein the practice club head also comprises a wind resistant fin spaced rearwardly from the striking face thereof, said fin having an exposed front surface area including the area of the striking face which is substantially identical to the front cross-sectional area of the golf club head, said fin being disposed at an incline with respect to the striking face of the practice club head.

6. A practice golf club as set forth in claim 5 wherein the resistance fin including the striking face has the same frontal shape as that of the front cross-sectional shape of the golf club head.

* * * * *